United States Patent [19]

Yane

[11] 4,158,764

[45] Jun. 19, 1979

[54] DEVICE FOR HEATING LIQUID IN A CONTAINER

[76] Inventor: Frank J. Yane, 215 Butternut La., Northfield, Ohio 44067

[21] Appl. No.: 756,249

[22] Filed: Jan. 3, 1977

Related U.S. Application Data

[63] Continuation-in-part of Ser. No. 589,798, Jun. 24, 1975, abandoned.

[51] Int. Cl.[2] ..... H05B 3/06

[52] U.S. Cl. ..... 219/523; 219/538; 219/541; 219/544; 219/549; 338/210; 338/259; 338/268

[58] Field of Search ..... 219/523, 535, 536, 538, 219/541, 544, 316, 549; 338/210, 214, 222, 259, 267–270

[56] References Cited

U.S. PATENT DOCUMENTS

| | | | |
|---|---|---|---|
| 846,853 | 3/1907 | Howell | 338/213 |
| 1,474,887 | 11/1923 | Bridges | 338/214 |
| 2,614,200 | 10/1952 | McNair | 219/523 |
| 2,639,359 | 5/1953 | Glenn | 219/528 |
| 2,654,820 | 10/1953 | Irving | 219/335 |
| 2,808,492 | 10/1957 | Yohe | 338/251 |
| 2,809,268 | 10/1957 | Heron | 219/544 X |
| 3,225,321 | 12/1965 | Walter | 219/523 X |
| 3,403,368 | 9/1968 | Scardina | 338/270 |
| 3,429,035 | 2/1969 | Norton | 338/268 X |
| 3,546,654 | 12/1970 | Rogal et al. | 338/268 |
| 3,593,002 | 7/1971 | Herbert | 219/544 |
| 3,657,520 | 4/1972 | Ragault | 338/214 |
| 3,663,799 | 5/1972 | McArn | 338/214 X |
| 3,674,985 | 7/1972 | Ragault | 219/523 |

FOREIGN PATENT DOCUMENTS

| | | | |
|---|---|---|---|
| 1516660 | 3/1967 | France | 219/236 |

*Primary Examiner*—E. A. Goldberg
*Assistant Examiner*—M. Paschall
*Attorney, Agent, or Firm*—Roger A. Johnston

[57] ABSTRACT

The device includes a coiled conductor formed of an alloy having a high electrical resistance and has an outer tubular casing of plastic material which is inert to acid or alkaline solutions. A flexible sleeve braided of fibrous glass material is slidably assembled on the coiled wire and the sleeve with coiled wire within is inserted as a subassembly into the outer tubular member to form an assembly for immersion in the liquid to be heated. Opposite ends of the heating cable extend above the liquid for attachment to electrical connections from a source of electrical power. Ground wires may also be provided to permit running of the electrical energy to ground in the event the outer tubular member is ruptured in service. Support rods are usually provided to anchor the cable to the desired configuration when immersed in the liquid to be heated.

4 Claims, 2 Drawing Figures

DEVICE FOR HEATING LIQUID IN A CONTAINER

CROSS REFERENCE TO RELATED APPLICATION

This application is a continuation-in-part of my copending application, Ser. No. 589,798 now abandoned filed June 24, 1975.

BACKGROUND OF THE INVENTION

The present invention relates to a heater cable for immersion in a liquid to be heated in a container for any desired purpose. More particularly, it is adapted for immersion in a solution in a container to maintain the solution at a desired temperature during a plating operation.

In the design and manufacture of electrical resistance heaters for immersion in liquid baths, or immersion heaters, as they are called, it is desirable to protect the electrical heating element from any corrosive effects of the bath. It is also desirable to have a high degree of flexibility to the heater cable to permit coiling or winding on supports to increase the length of heater which may be immersed in the bath. Flexible immersion heaters having an inert plastic encasing the heating element are known in the art, as for example, those described in U.S. Pat. Nos. 3,674,985 and 3,657,520 issued to M. A. Ragault. However, such known immersion heaters lack the desired flexibility because a solid linear heating element is used with a braided glass sheath covered with a coating of rubber bonded to the outer surface of the sheath. A heater cable has been disposed in a coiled arrangement in the liquid to be heated as in the Ragault U.S. Pat. No. 3,674,985 patent; however, the prior art heater cable has employed a solid linear conductor. Such an arrangement has been found limited in its flexibility, and therefore unable to provide the desired heating capacity for a cable occupying a given amount of space in the solution.

SUMMARY OF THE INVENTION

The present invention provides a solution to the above described problems with known immersion heaters in that the present immersion heater cable is formed of a coiled resistance element, first encased in a flexible sheath of braided fibrous glass material and then encased within an inert fluid impervious outer casing. The braided glass sheath provides desirable flexibility, and upon bending or tension of the subassembly thus formed, the braided sheath functions to hold the coiled resistance element in the desired configuration and prevents deformation and collapse with consequent shorting of adjacent pitches of the coiled resistance element. The combination of a coiled resistance element within a braided sheath of fibrous glass material permits a heretofor unobtainable ease of assembly of a coiled element into an outer casing and further permits a heretofor unobtainable length of coiled resistance element of relatively small coil diameter to be successfully assembled into an outer casing without prohibitive distortion of the coiled resistance element.

BRIEF DESCRIPTION OF THE DRAWINGS

FIG. 2 is a fragmentary view of a portion of the heating cable of FIG. 1 adjacent one end prior to coiling on the supports and shows the arrangement of the internal components in enlarged detail.

DETAILED DESCRIPTION

Figure 1:
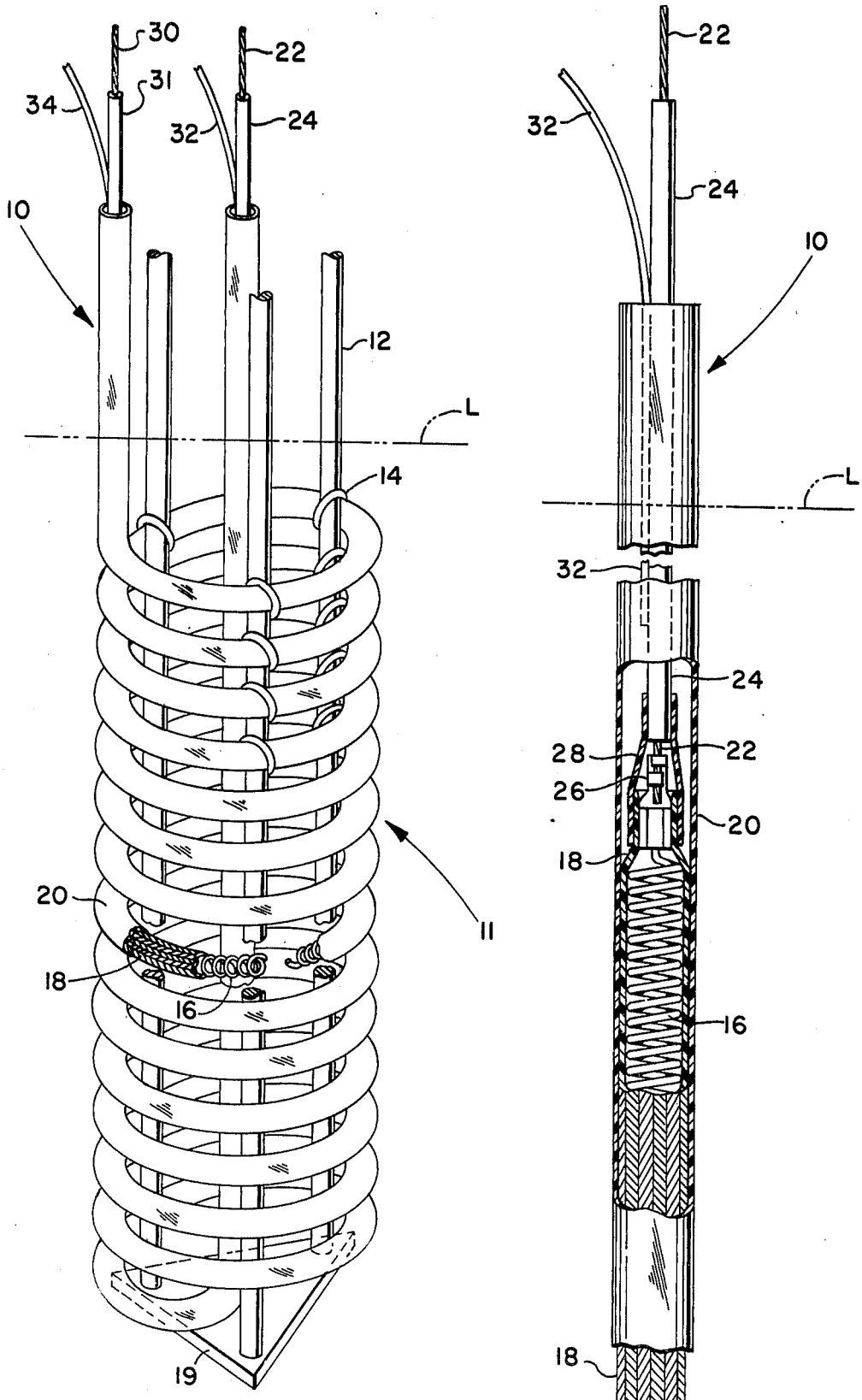
FIG. 1 is a perspective view of the cable of the present invention arranged in a coiled configuration on support rods for immersion in a liquid to be heated and shows a portion of the heating cable casing broken away to expose the internal components of the heating cable.

Referring now to FIGS. 1 and 2 of the drawings, the improved heating cable of the present invention denoted generally by the numeral 10 is disposed in a coiled configuration about support rods 12 which may have a spacer plate 19 provided at the lower or immersed end, and which are attached to any suitable supporting structure (not shown) on the opposite (upper) ends, usually anchored to the wall of the container for the liquid to be heated. Coils 11 of the cable are preferably in open spaced arrangement and are secured to the support rods 12 typically by straps 14 a few of which are illustrated and which are formed of any suitable material resistant to the corrosive effects of the liquid in which the cable 10 is to be immersed. The ends of the cable 10 both extend above the liquid level, shown in dashed line and indicated by letter L in FIGS. 1 and 2. The particular arrangement of the heater cable on the support rods 12 can be varied as desired, for example, to have a planar serpentine configuration rather than the coiled arrangement shown in FIG. 1 and the particular configuration of the heater cable below the liquid level forms no part of the present invention. However, the coiled arrangement of FIG. 1 has been found particularly compact and is preferred.

The heater cable 10 of the present invention has an inner, central conductor 16 formed of an alloy having high electrical resistance coiled in open pitch arrangement having a coil diameter sized for a given conductor wire diameter to give the desired degree of rigidity for convenience of handling and assembly. In the presently preferred practice of the invention, the coiled conductor 16 is formed of an alloy of iron and nickel, iron and chromium, or iron-nickel-chromium. Alloys which have been found particularly satisfactory are the % Ni-20%, Cr-60%, Ni-24%, Fe+16% Cr+0.1%. Another satisfactory alloy is that sold under the trademark "Chromel". However, any suitable electrical resistance wire known in the art having the desired electrical properties may be employed.

Coiled resistance element 16 is encased in a tubular sheath formed of braided fibrous glass material sized so as to be closely fitting over the outside diameter of the coils of the resistance element. The braided glass sheath 18 must have its inside diameter as near the diameter of coil 16 as is possible and yet permit the sheath 18 to slide over coiled element 16 for reasons set forth below. A particularly satisfactory arrangement of the cable 10 has employed a coil 16 having an outside diameter of about one-quarter of an inch and having a length of about up to thirty feet. The subassembly of the resistance element 16 with the braided glass sheath 18 received thereover is encased with an outer protective tubing 20 of a suitable electrical insulating material which is impervious to chemical attack by the liquid in which the heater cable 10 is to be immersed. In the present practice of the invention, the outer tubular member 20 has satisfactorily been formed of material such as polypropylene or polyethylene or polytetrafluoroethylene.

With reference particularly to FIG. 2 a typical end region of the cable 10 is shown wherein the end of the resistance element 16 is connected by any suitable connector means known in the art to one end of an electrical lead in 22 which has suitable electrical insulation 24. The braided glass sheath 18 terminates adjacent the electrical connector 26 which connection is encased in suitable insulation 22 as for example a wrap of insulating tape, or a section of shrinkable tubing, either of which is applied so as to bridge the gap between the braided glass sheath and the insulation 24 on the electrical lead-in. Insulation 22 serves to anchor the end of the sheath 18 to the connector 26 to aid in assembling the sheathed coil 16 into outer casing 20. Electrical connector 22 is initially provided a length somewhat greater than the desired length of the cable 10 to enable the conductor to be first assembled outer casing 20 to permit pulling the subassembly of the resistance element 16 and braided glass sheath 18 through the outer casing 20. As mentioned above, the outer casing 20 may be formed of any suitable plastic material and have the wall thereof sufficiently thin to provide the desired degree of flexibility. Once the cable 10 is assembled the braided glass sheath within the outer tubular casing 20 serves to protect and hold the coils of the resistance element 16 in the desired coiled configuration and prevent deformation thereof in the event of kinking or overbending of the heater cable 10. As the cable 10 is bent or coiled about a decreasing radius the sheath 18 is placed longitudinal tension at the outer bend radius and in tension about the transverse circumference by the tendency of the coiled element 16 to deform; and, the tensioning of the braided sheath 18 resists further deformation or distortion of the coils of element 16. Without the braided glass sheath 18, the coils of the resistance element 16 would be collapsed and permanently deformed by short-radius bending of the assembly and particularly bending or coiling tight enough to cause creasing of the flexible outer casing 20.

The opposite end of resistance coil 16 is also connected to an electrical lead in 30 similar to the lead in 22 of FIG. 2. In the presently preferred practice of the invention the outer casing 20 extends beyond the electrical connector 26 a distance of about twenty-four to thirty inches. The electrical lead-in conductors 22 and 30 preferably extend about eight inches beyond the ends of the outer tubular member 20. In use, cable 10 is immersed in the liquid to be heated such that electrical connectors such as 26 are below the liquid level and the outer tubular member 20 has its ends continuing above the liquid level L.

This arrangement provides cold zones or non-heating portions of the cable adjacent the ends thereof to permit the cable to carry relatively great amounts of electrical power without heating the outer tubular member 20 in the end regions thereof. Upon connection of the lead in conductors 22, 30 to a suitable source of electrical power, current flowing in one of the lead-in connectors flows continuously through the resistance elements 16 and through the other electrical lead-in conductor. If desired, as a safety precaution, ground wire such as wires 32, 34 may be provided along the lead-in conductors 22, 30 in the outer tubular member 20, which ground wires terminate in about three-quarters of an inch from the end of the insulation 24 of the electrical lead-in. Ground wires 32, 34 are thus disposed in parallel arrangement along the surface of the insulation on the electrical lead-in conductors but are completely isolated from the electrical circuit. Ground wires 32, 34 extend out of the end of the tubular member approximately eight inches to permit convenient attachment to a satisfactory ground. The end of each of the ground wires 32, 34 extending down in the tubular member 20 must terminate below the liquid level L. In the event of rupture of tubular member 20 liquid entering the casing 20 would shunt the electrical power from the heater 16 through the ground wires 32, 34.

The purpose of the ground wires is to furnish a path for electrical energy in the event of rupture of outer tubular member 20 below the liquid level by running the electrical power to ground rather than through liquid in which the cable 10 is immersed, thus rendering the heating cable safe for persons working in the vicinity of the liquid container.

It will, of course, be understood that each end of the heating cable above the liquid level is adapted to be electrically and mechanically attached to a suitable source of electrical energy.

Those of ordinary skill in the art will recognize the invention is capable of modification and variation, and is therefore limited only by the following claims.

I claim:

1. A flexible heating cable assembly for immersion heating of a liquid in a container, said cable comprising:

(a) a heating element disposed in coiled, axially spaced internally unsupported pitches of substantially uniform diameter having a length substantially greater than the coil diameter, said element being formed of bare wire having a high electrical resistance;

(b) a flexible braided sheath of fibrous glass material received over said coiled pitches along the length thereof, said sheath having the inner periphery thereof disposed in closely fitting arrangement with the outer diameter of said coiled pitches and in direct free sliding contact therewith;

(c) an outer tubular casing formed of resilient electrical insulating material having a low surface coefficient of friction and a high resistance to heat and attacks by acid and alkaline solutions, said casing being received over said sheathed coiled element and in direct free sliding contact with said braided sheath along the length thereof;

(d) connecting means attached to each end of said coiled element and disposed within said casing;

(e) power lead means attached to each of said connectors, said lead means extending beyond the respective adjacent end of said casing, said lead means being adapted for connection to a source of electrical power; and (f) said braided sheath being sized such that upon flexing of said cable assembly, deformation, axial contact and collapse of said coiled pitches of said element are resisted by tensioning of the braid of the sheath.

2. The cable assembly defined in claim 1, further comprising a grounding lead of high electrical conductivity extending from each end of the casing, each grounding lead having an exposed end within the casing arranged in spaced proximity to the respective connector at the end of the coiled element, each grounding lead being arranged such that upon immersion of said cable assembly in the liquid to be heated and upon application of electrical power thereto through said leads, said grounding leads extend below the level of the liquid being heated for providing a harmless path for flow of electrical current in the event that the casing leaks liquid to the interior thereof, said grounding leads being completely electrically insulated from the connectors, coiled element and power lead means.

3. The cable assembly defined in claim 1, further comprising insulating means covering said connecting means and interconnecting said sheath and the adjacent end of the insulation of each of said electrical leads.

4. The cable assembly defined in claim 1, wherein said casing is formed of polytetrafluoroethylene plastic material.

* * * * *